US012529173B2

(12) United States Patent
Rizzi et al.

(10) Patent No.: US 12,529,173 B2
(45) Date of Patent: Jan. 20, 2026

(54) DRIVE CHAIN FOR STITCH FORMATION MEMBERS OF A CIRCULAR KNITTING MACHINE AND A CIRCULAR KNITTING MACHINE COMPRISING SUCH DRIVE CHAIN

(71) Applicant: SANTONI S.P.A., Brescia (IT)

(72) Inventors: Stefano Rizzi, Brescia (IT); Marco Andreoli, Castegnato (IT); Andrea Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 0 days.

(21) Appl. No.: 18/698,887

(22) PCT Filed: Sep. 30, 2022

(86) PCT No.: PCT/IB2022/059337

§ 371 (c)(1),
(2) Date: Apr. 5, 2024

(87) PCT Pub. No.: WO2023/057867

PCT Pub. Date: Apr. 13, 2023

(65) Prior Publication Data

US 2025/0223739 A1 Jul. 10, 2025

(30) Foreign Application Priority Data

Oct. 8, 2021 (IT) ..... 102021000025898

(51) Int. Cl.
*D04B 15/16* (2006.01)

(52) U.S. Cl.
CPC ..... *D04B 15/16* (2013.01)

(58) Field of Classification Search
CPC .... D04B 15/16; D04B 15/322; D04B 15/665; D04B 15/68; D04B 15/78
See application file for complete search history.

(56) References Cited

U.S. PATENT DOCUMENTS 3,823,579 A * 7/1974 Schindele ..... D04B 15/78 66/219
3,890,805 A * 6/1975 Bourgeois ..... D04B 15/78 66/220

(Continued)

FOREIGN PATENT DOCUMENTS

CN 104120545 A 10/2014

OTHER PUBLICATIONS

International Search Report and Written Opinion dated Dec. 6, 2022 in corresponding International Application No. PCT/IB2022/059337, 11 pages.

*Primary Examiner* — Danny Worrell
(74) *Attorney, Agent, or Firm* — MH2 TECHNOLOGY LAW GROUP LLP

(57) ABSTRACT

A drive chain for stitch formation members of a circular knitting machine includes an element coupled or to be coupled with a stitch formation member and an oscillating lever connected to said element on a junction area. The oscillating lever is configured for interacting with selecting devices so as to oscillate with respect to said element. The element comprises a first portion carrying a first butt and a second portion configured for slidingly coupling with a bottom of a respective groove. Along a main direction of development of the drive chain, the junction area is placed between the stitch formation member and the first butt.

15 Claims, 17 Drawing Sheets

(56) References Cited

U.S. PATENT DOCUMENTS

| | | | | |
|---|---|---|---|---|
| 4,197,722 | A | 4/1980 | Cote-Petit et al. | |
| 4,827,740 | A * | 5/1989 | Cottenceau | D04B 15/68 66/220 |
| 6,014,875 | A * | 1/2000 | Lonati | D04B 15/68 66/220 |
| 6,141,994 | A * | 11/2000 | Plath | D04B 15/78 66/219 |
| 6,705,130 | B2 * | 3/2004 | Weihing | D04B 15/68 66/123 |
| 7,685,845 | B2 * | 3/2010 | Lonati | D04B 15/68 66/216 |
| 7,770,417 | B2 * | 8/2010 | Lonati | D04B 15/78 66/219 |
| 7,836,730 | B1 * | 11/2010 | Pai | D04B 15/68 66/123 |
| 2009/0139272 | A1 * | 6/2009 | Lonati | D04B 15/78 66/107 |
| 2015/0197880 | A1 * | 7/2015 | Lonati | D04B 15/78 66/219 |

* cited by examiner

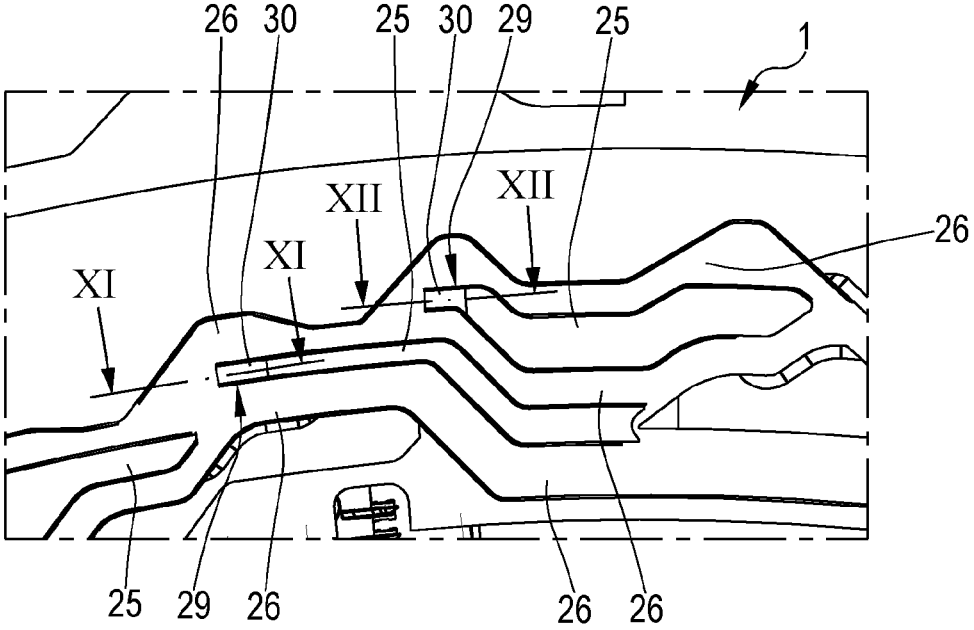
FIG.10
FIG.11
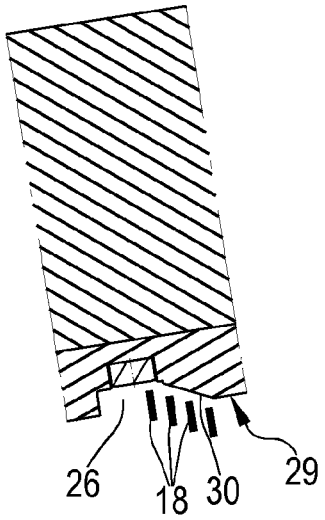
FIG.12
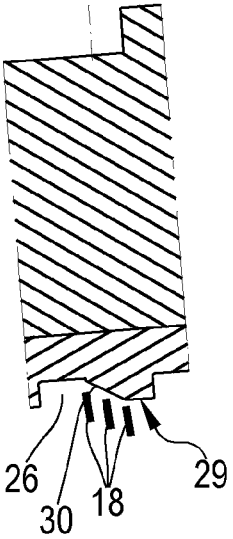

DRIVE CHAIN FOR STITCH FORMATION MEMBERS OF A CIRCULAR KNITTING MACHINE AND A CIRCULAR KNITTING MACHINE COMPRISING SUCH DRIVE CHAIN

CROSS-REFERENCE TO RELATED APPLICATIONS

This application is a U.S. National Stage application of PCT/IB2022/059337, filed Sep. 30, 2022, pending, which claims priority to Italian Patent Application No. 102021000025898, filed Oct. 8, 2021, the entire disclosures of which are hereby incorporated by reference in their entireties.

FIELD OF THE INVENTION

The present invention relates to a drive chain operatively associated to or integrating a stitch formation member, such as e.g. a needle or a sinker, which is part of a circular knitting machine.

The present invention also relates to a circular knitting machine comprising such a drive chain.

In particular, the present invention concerns the structure of drive chains actuating stitch formation members by transforming a relative rotary movement between the drive chains and the actuating cams into axial movements of the stitch formation members.

More particularly, the present invention relates to a structure of drive chains of circular knitting machines which enable a one-to-one selection of stitch formation members according to different paths based on the braid to be obtained (needle-needle selection).

BACKGROUND OF THE INVENTION

As is known, circular knitting machines comprise a needle-holding element (needle cylinder and/or plate) on which one or more series of needles are arranged in respective grooves along a circular path (circular needlebeds), and devices apt to control the movement of the needles for knitted fabric formation.

Some machine types further comprise knockover sinkers arranged in radial seats obtained in a ring-shaped body (sinker crown) arranged around the needle-holding cylinder, and said sinkers cooperate with the needles so as to make knitted fabric. The devices for controlling the needles of the needle-holding cylinder comprise actuating cams arranged around the cylinder itself, and drive chains configured for operatively connecting the cams to the needles. Each of such drive chains comprises one or more flat parts inserted into each groove and below each needle. Drive chains exhibit butts configured for cooperating with the actuating cams.

It is known about circular knitting machines with needle-needle selection, i.e. provided with systems enabling a one-to-one selection of needles according to different paths based on the knitted braid to be obtained.

For instance, a drive chain type consisting of a sub-needle and an oscillating lever hinged to the sub-needle is known. The sub-needle exhibits a fixed butt which, when inserted into the sliding seat of the cylinder, protrudes from the respective groove. The oscillating lever exhibits a moving butt and a selecting tooth configured for interacting with piezoelectric devices provided with actuating levers. The fixed butt cooperates with respective cams so as to align the selecting tooth with actuating levers of the piezoelectric devices so that, if selected, the moving butt can engage a lifting cam.

Moreover, it is known about drive chains consisting of sub-needle and oscillating lever, which instead of interacting with said piezoelectric devices cooperate with actuating electromagnets.

For instance, patent IT1293789, issued to the same Applicant, discloses a needle comprising a lower portion, also called sub-needle, which exhibits a fixed butt and is provided on its longitudinal end opposed to the tip with an oscillating lever hinged to the needle, which rotates around a hinging axis basically perpendicular to the lying plane of the needle sides.

The oscillating lever comprises a moving butt and it is provided for actuating cams facing the needle-holding member and defining paths to be engaged by the fixed butt of the sub-needle and paths to be selectively engaged by the moving butt of the oscillating lever. The oscillating lever is rotated between an operating position and a non-operating position by electromagnetic means.

SUMMARY

In the framework of circular knitting machines equipped with needles paired to sub-needles and oscillating levers, as the ones disclosed above, the Applicant has identified the presence of some drawbacks.

In particular, the Applicant has found out that, although drive chains consisting of sub-needle and oscillating lever are compact and allow to limit machine size, the selection accuracy they offer is not so high. This accuracy depends indeed on the length of the oscillating lever since, the angle of rotation around the pivot being the same, the linear movement of an element of the oscillating lever, such as e.g. the tooth and/or the moving butt mentioned above, depends on the distance of the element from the pivot and this distance is relatively small.

The Applicant has also found out that, during machine operation, it may happen that the fixed butt of the sub-needle, instead of taking a path delimited by the cams by touching or sliding over a cam, hits the cam itself and breaks or in some way is so damaged that the correct movement of the needle and sub-needle is compromised. Such a malfunction makes it necessary to stop the machine so as to make the required repairs, which means downtime and less productivity.

Under these circumstances, an aim underlying the present invention in its various aspects and/or embodiments is to propose a drive chain which enables to increase selection accuracy, though keeping at the same time the overall size of the drive chain basically unchanged with respect to drive chains of the prior art.

A further aim of the present invention is to propose a drive chain for stitch formation members of a circular knitting machine which allows to avoid breaks of the butt belonging to the element integrating the stitch formation member or coupled or to be coupled with the stitch formation member.

An aim of the present invention is therefore to propose a drive chain which makes the circular knitting machine safer and more reliable.

Another aim of the present invention is to propose a drive chain which enables to increase the productivity thereof and to reduce maintenance costs of circular knitting machines.

These and other possible aims, which shall appear better from the following description, are basically achieved by a drive chain for stitch formation members of a circular knitting machine and by a circular knitting machine according to one or more of the appended claims and according to the following aspects and/or embodiments, variously combined, possibly also with the aforesaid claims.

In the present description and in the appended claims, the words "upper", "lower", "above" and "below" relate to the positioning of the machine during normal operation with the central axis of rotation of the needle-holding cylinder in vertical position and the cylinder needles pointing upwards. In the present description and in the appended claims, the words "axial", "circumferential", "radial" relate to said central axis.

Some aspects of the invention are listed below.

In one independent aspect, the invention relates to a drive chain for stitch formation members of a circular knitting machine, comprising:

an element incorporating a stitch formation member or operatively coupled or to be coupled with a stitch formation member; wherein said element has a first butt configured for engaging into first paths defined by first actuating cams of a circular knitting machine;

an oscillating lever connected to said element on a junction area and extending, with respect to said element, on the opposed side to said stitch formation member; the oscillating lever exhibiting a second butt;

wherein the oscillating lever is configured for interacting with at least one selecting device of the circular knitting machine so as to oscillate with respect to said element between an extracted position, in which the second butt is taken out of a respective groove of a support of the circular knitting machine and is engaged with second paths defined by second actuating cams, and a retracted position, in which the second butt is retracted into the respective groove so as not to engage into said second paths.

According to an independent aspect of the present invention, along a main direction of development of the drive chain, i.e. along a longitudinal direction of development of the respective groove, said junction area is located between the stitch formation member and the first butt.

According to a different aspect of the present invention that may or not depend on the previous aspect, given Z a distance between the junction area and the second butt and given K a distance between an end belonging to the element exhibiting the first butt and the second butt, a ratio K/Z is between 1.1 and 1.5.

According to a different aspect of the present invention that may or not depend on the previous aspects, given X a distance between the junction area and the first butt and given Z a distance between the junction area and the second butt, a ratio Z/X is greater than 2, optionally the ratio Z/X is between 2 and 6, optionally the ratio Z/X is between 4 and 5.

In one aspect, the invention relates to a circular knitting machine, comprising:

a support having a plurality of grooves arranged around a central axis of said support;

a plurality of stitch formation members, each being housed at least partially in a respective groove;

first actuating cams and second actuating cams facing the grooves; wherein the support is movable with respect to the first actuating cams and second actuating cams around the central axis so as to determine or enable the movement of the stitch formation members along the grooves for stitch formation by said stitch formation members;

a plurality of drive chains, each being carried out according to the preceding aspect and/or to one or more of the following aspects; wherein each drive chain is housed in a respective groove and integrates a stitch formation member or is operatively coupled or to be coupled with a stitch formation member;

at least one selecting device interacting with the drive chains.

The Applicant has verified that the invention allows to achieve the aims set above.

The Applicant has first verified that the invention allows to improve machine accuracy, e.g. as far as operating tolerance is concerned. As a matter of fact, by moving the pivot/joint towards the stitch formation member and thus extending the oscillating lever, selection accuracy can be highly increased, even doubled with respect to a traditional drive chain, e.g. the one disclosed in patent IT1293789.

The Applicant has therefore verified that the invention allows to make circular knitting machines that are so much safer and more reliable as to increase productivity and reduce maintenance costs.

Further aspects of the invention are listed below.

In one aspect, the stitch formation member is a needle or a sinker or a punch or a reed or a hook.

In one aspect, the support is a cylinder or a plate or a crown.

In one aspect, the grooves are parallel to the central axis or radial with respect to the central axis.

In one aspect, the first actuating cams and the second actuating cams are fixed and the support rotates around the central axis or, vice versa, the support is fixed and the first actuating cams and the second actuating cams rotate around the central axis.

In one aspect, the element exhibiting the first butt, the oscillating lever and the stitch formation member are flat parts of the circular knitting machine.

In one aspect, the stitch formation member rests or is configured for resting (in at least some operating steps) against said element exhibiting the first butt.

In one aspect, the stitch formation member and/or the element exhibiting the first butt exhibit/s a hook configured for mutually hooking said stitch formation member and said element exhibiting the first butt.

In one aspect, the first portion defined a hook to be engaged into and disengaged from a seat obtained in the stitch formation member.

In one aspect, the element exhibiting the first butt comprises a first portion carrying the first butt and a second portion configured for slidingly coupling with a bottom of the respective groove.

In one aspect, the junction area is located between the first portion and the second portion.

In one aspect, a segment of the oscillating lever is positioned between the first portion and the second portion.

In one aspect, the junction area mutually connects the first portion and the second portion.

In one aspect, the first portion is elastically coupled with the second portion so as to keep the first butt in an operating position in which said butt protrudes from the groove and to allow the first butt to get back into the groove in case of interference with one of the first actuating cams.

The Applicant has verified that the invention allows to prevent the first butt (the one placed bear the stitch formation member and part of the element integrating said stitch formation member or operatively coupled or to be coupled with said stitch formation member) from hitting the cams and thus breaking or damaging the first butt itself and/or the drive chain which the first butt is part of. The Applicant has indeed verified that the invention allows to embed the first butt into the respective groove in case it interferes with one of the first actuating cams. Moreover, this (embedding) movement is obtained without increasing the size of the drive chain with respect to known drive chains, i.e. to those having a fixed butt that cannot be embedded.

The Applicant has further verified that the embedding and the springback of the first butt allow to retrieve the position of the drive chain and of the stitch formation member. As a matter of fact, the first butt, after getting back into the groove due to the erroneous interaction with a cam or due to an incorrect positioning by the operator, when it finds a suitable space, gets out again of the groove, pushed by the aforesaid elastic coupling, and retrieves one of the programmed tracks/paths delimited by the respective cams.

In one aspect, when the first butt gets back into the groove, the hook disengages from the seat obtained in the stitch formation member.

In one aspect, the stitch formation member is made as one piece with said element exhibiting the first butt, optionally with the second portion of said element.

In one aspect, the stitch formation member is stiffly connected to said element exhibiting the first butt.

In one aspect, the stitch formation member is connected to said element exhibiting the first butt by means of a yielding, optionally elastic, connection.

In one aspect, the yielding connection is a thin, flattened portion extending along the groove.

In one aspect, the element exhibiting the first butt comprises an elastic joint connecting the first portion to the second portion, so that the first portion can elastically rotate with respect to the second portion.

In one aspect, the yielding connection is configured for allowing the rotation of the first portion with respect to the second portion while the stitch formation member is still aligned with the respective groove, i.e. it is not inclined.

In one aspect, when the first portion rotates, the yielding connection is bent in a radial plane, thus forming a sort of wave.

In one aspect, the elastic joint is a torsion spring.

In one aspect, the elastic joint is placed on the junction area.

In one aspect, the elastic joint and the junction area are at least partially integrated with each other.

In one aspect, the oscillating lever can oscillate between the extracted position and the retracted position by rotating around an axis of rotation placed in the junction area or near the junction area.

In one aspect, the oscillating lever is hinged to said element on a rotation pivot placed on the junction area.

In one aspect, the junction area comprises a rotation pivot.

In one aspect, the junction area is defined by a rotation pivot.

In one aspect, the elastic joint delimits the rotation pivot.

In one aspect, the oscillating lever is hinged to said element on said rotation pivot.

In one aspect, the rotation pivot basically coincides with a center of rotation of the first portion with respect to the second portion.

The Applicant has verified that the integration of the elastic joint with the rotation pivot of the oscillating lever allows to choose with a higher degree of freedom, within certain limits, the portion of the pivot/joint along the drive chain based on the functional features to be obtained.

In one aspect, the junction area and/or the elastic joint exhibit/s a C or open ring shape.

In one aspect, the elastic joint partially surrounds a proximal end of the oscillating lever, so that said proximal end can rotate inside the elastic joint.

In one aspect, a proximal end of the oscillating lever exhibits an at least partially circular shape so as to rotate inside the elastic joint.

In one aspect, the elastic joint is configured for leaving a minimal clearance at the proximal end of the oscillating lever even when said elastic joint is in a configuration of maximum torsion in which the first butt is back into the groove. Thus, the minimum operating clearance allows the pivot to rotate even when the elastic joint reaches its maximum torsion.

In one aspect, the junction area, optionally the rotation pivot, is closer to the stitch formation member than to the first and to the second butt.

In one aspect, given Y a distance between a connection or interaction area of the stitch formation unit with the drive chain and the elastic joint and given X a distance between the elastic joint and the first butt, a ratio X/Y is greater than 1.

In one aspect, said ratio X/Y is between 2 and 5.

In one aspect, the first portion mainly develops from the rotation pivot towards the second butt and exhibits an edge facing the oscillating lever.

In one aspect, the edge is configured for engaging with the oscillating lever and shifting said oscillating lever to the non-operating position, when the first butt gets back into the groove.

In one aspect, the edge is configured for pushing the oscillating lever to the non-operating position.

The Applicant has verified that the particular interaction between the embedding of the butts (the first butt embeds the second one but not vice versa) allows, in case of contact of the first butt, to interrupt the translational movement in the groove imparted by the second butt. Therefore, the system is fully safe and configured as if it were a force limiter: in case of selection problems, the drive chain interrupts the translation.

In one aspect, the first portion comprises a stroke end arranged, along a main direction of development of the drive chain, between the elastic joint and the stitch formation member.

In one aspect, when the first butt is in the operating position, the stroke end rests against the bottom of the respective groove and, when the first butt gets back into the groove, the stroke end gets away from the bottom of the respective groove.

The Applicant has verified that the stroke end prevents the first butt from protruding more than it is necessary from the respective groove, thus avoiding a possible further contact with parts of the cams.

In one aspect, the first portion comprises a part arranged, along a main direction of development of the drive chain, between the elastic joint or the junction area and the stitch formation member.

In one aspect, said part exhibits a height basically corresponding to a depth of the groove.

In one aspect, said part exhibits a radially outer edge that is rounded so as to never protrude from the groove even when the first portion rotates with respect to the second portion.

In one aspect, said part exhibits an arc shape and is arranged partially around the elastic joint.

In one aspect, said part and said elastic joint delimit between them an arc-shaped slot.

The Applicant has verified that said part allows to better tolerate side loads acting upon the first butt. The Applicant has also verified that said part acts as a guide for the drive chain in the groove and ensures a more regular and smoother movement of the flat parts (stitch formation member and drive chain) in said groove.

In one aspect, said part comprises the stroke end.

In one aspect, the stroke end is defined by an edge of said part facing the bottom of the respective groove.

In one aspect, the oscillating lever exhibits at least one selecting tooth configured for interacting with at least one arm of a selecting device of arm type.

In one aspect, in which given H a distance between the junction area and said at least one selecting tooth, a ratio H/K is between 0.5 and 0.9.

In one aspect, a ratio H/Z is between 0.55 and 0.95.

In one aspect, the second butt is located at a distal end of the oscillating lever.

In one alternative aspect, the oscillating lever exhibits a distal segment configured for interacting with a selecting device of magnetic type.

In one aspect, given W a distance between the junction area and a portion of the distal segment (configured for interacting with the selecting device of magnetic type) placed closer to said junction area, a ratio W/K is between 1 and 1.3.

In one aspect, a ratio W/Z is between 1.4 and 1.8.

In one aspect, said distal segment of the oscillating lever is configured for elastically bending.

In one aspect, the second butt is located between the first butt and the distal segment configured for elastically bending of the oscillating lever.

In one aspect, the second portion comprises at least one segment shaped like a flattened rod.

In one aspect, the second portion comprises an elastically deformable distal segment exhibiting its own distal end resting upon the oscillating lever.

In one aspect, the elastically deformable distal segment is configured for pushing the oscillating lever towards the extracted position and for keeping said oscillating lever in the extracted position.

In one aspect, the junction area comprises an auxiliary elastic joint and the oscillating lever is connected to said element by means of said auxiliary elastic joint.

In one aspect, a proximal end of the oscillating lever is made as one piece with the elastic joint on the junction area.

In one aspect, a proximal end of the oscillating lever is located inside the C or open ring shape.

In one aspect, the auxiliary elastic joint is configured for deforming, optionally bending, elastically when the oscillating lever oscillates.

In one aspect, the first actuating cams comprise at least one deviating cam configured for interacting with the first butt and directing it into one of the first paths or into another one of the first paths.

In one aspect, said deviating cam exhibits a ramp configured for progressively pushing the first butt into the groove in case of interference with said deviating cam.

In one aspect, said at least one selecting device is of arm type, optionally with piezoelectric actuation, and interacts with a selecting tooth carried by the oscillating lever of the drive chain.

In one alternative aspect, said at least one selecting device is of magnetic type, optionally of electromagnetic type with single or multiple magnets, and interacts with a distal segment of the oscillating lever of the drive chain, optionally configured for bending elastically.

Further characteristics and advantages shall be more evident from the detailed description of preferred embodiments of a drive chain for stitch formation members of a circular knitting machine according to the present invention.

DESCRIPTION OF THE DRAWINGS

This description shall be made below with reference to the accompanying drawings, provided to a merely indicative and therefore non-limiting purpose, in which:

FIG. 10 is a magnified view of a part of the cams of FIG. 1;

FIG. 11 is a sectioned view according to plane XI-XI of FIG. 10;

FIG. 12 is a sectioned view according to plane XII-XII of FIG. 10;

DETAILED DESCRIPTION

With reference to the figures mentioned above, the drive chain according to the present invention is described in an exemplary and non-limiting manner with reference to its application in a needle-holding plate associated with respective actuating cams of a circular knitting machine for manufacturing fabrics, which is not shown as a whole.

Figure 1:
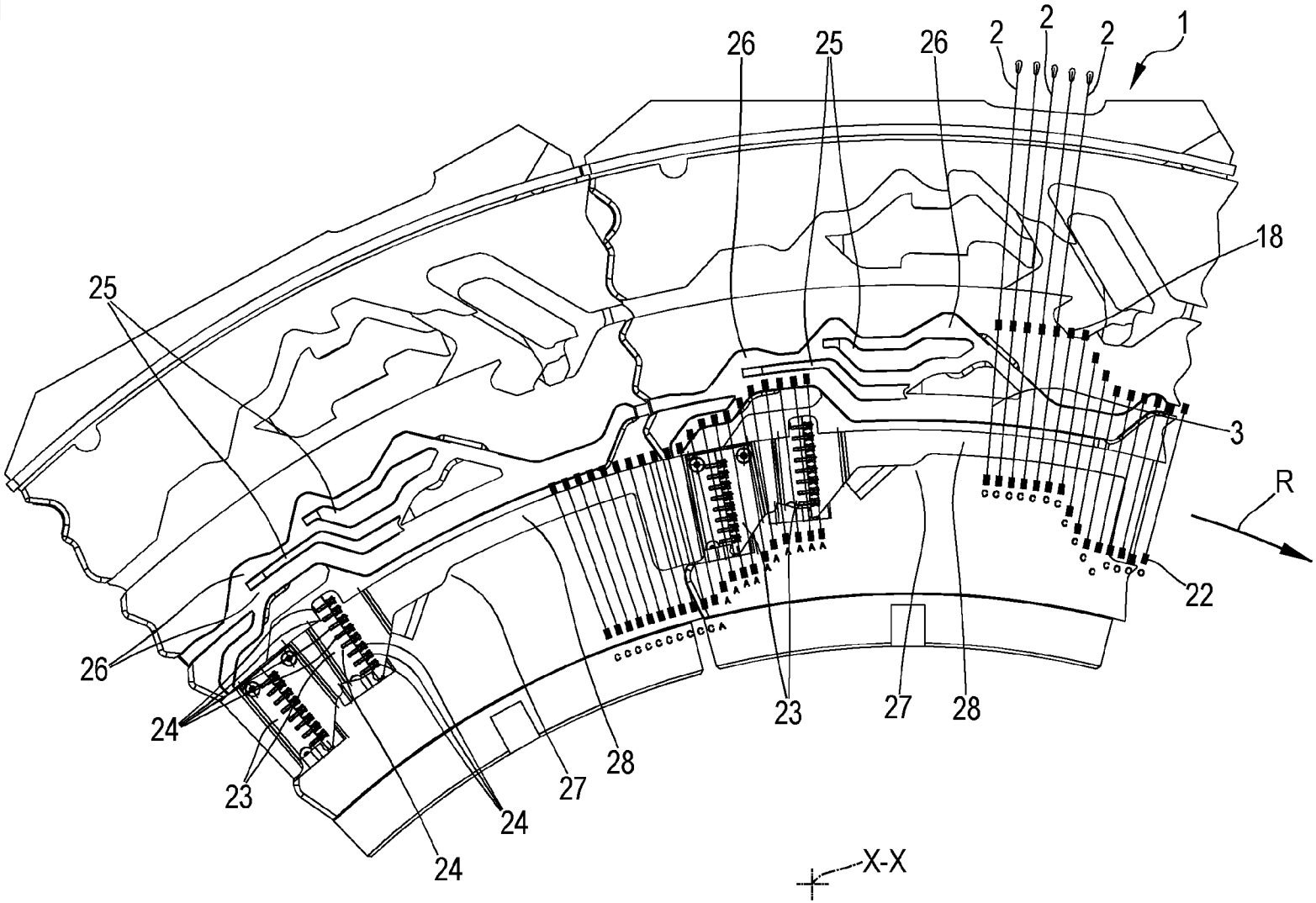
FIG. 1 shows a magnified portion of a detail of a circular knitting machine, in which drive chains according to the present invention are shown schematically, and needles paired with actuating cams.

As is known, the circular knitting machine comprises a basement constituting the supporting structure of the machine. A needle-holding cylinder is mounted vertically to the basement and has a plurality of longitudinal grooves obtained on a radially outer surface thereof. The longitudinal grooves are arranged around a central axis "X-X" of the needle-holding cylinder and usually develop parallel to said central axis "X-X". Each longitudinal groove houses respective drive chain, comprising a plurality of flat parts and, at least partially, a respective needle. Actuating cams are arranged as a casing around the needle-holding cylinder and lie facing the radially outer surface of the cylinder and thus the longitudinal grooves and the drive chains. These actuating cams delimit tracks/paths arranged on an inner surface of the casing. The machine here described by way of example further comprises a needle-holding plate exhibiting a plurality of grooves developing radially with respect to the central axis "X-X". Each radial groove houses a respective needle and a respective drive chain comprising a plurality of flat parts. Actuating cams supported by a disc face the needle-holding plate and the radial grooves and delimit respective tracks/paths. The needle-holding cylinder and the needle-holding plate are rotated (arrow R of FIG. 1) around the central axis "X-X" by a motor, while the casing and the disc with the actuating cams are fixed. The needles and/or drive chains are provided with butts engaged/to be engaged into the tracks/paths, so that the relative rotation between the needle-holding cylinder and the casing and between the needle-holding plate and the disc causes the needles to shift in the respective longitudinal and radial grooves. Selecting devices interact with the drive chains arranged in the longitudinal grooves and in the radial grooves so as to selectively actuate the needles so that they go along given tracks/paths and enable stitch formation, i.e. fabric production. FIG. 1 shows a lower portion of the disc associated with the needle-holding plate and referred to with numeral 1. The disc 1 exhibits the actuating cams delimiting tracks/paths which develop circumferentially around the central axis "X-X". FIG. 1 further shows schematically needles 2 and drive chains 3 according to the present invention, which are associated with the cams/tracks/paths and are housed in the radial grooves of the needle-holding plate, not shown in FIG. 1, which lies facing the disc 1.

FIGS. 2, 3, 4 and 5 show, in a section according to a radial plane containing the central axis "X-X", a portion of the needle-holding plate 4 and of the disc 1 and one of the drive chains 3 according to the present invention associated with the respective needle 2. The drive chain 3 is housed in a respective radial groove 5 of the needle-holding plate 4 and is open upwards. The disc 1 with the actuating cams is arranged above the needle-holding plate 4 and the tracks/paths delimited by the actuating cams face the radial grooves 5.

The drive chain 3 shown in FIGS. 2-5 comprises an element 6 (referred to as sub-needle in the specific case) to be operatively coupled with the respective needle 2, and an oscillating lever 7 hinged to said element 6 on a rotation pivot 8 defining an axis of rotation of the oscillating lever 7 which is orthogonal to the radial plane containing the central axis "X-X". The rotation pivot 8 defines a junction area between the oscillating lever 7 and the element 6.

In the example shown here, the needle 2 is at a distance from the drive chain 3 and is configured for contacting said element 6 and being pushed by the drive chain 3 during the operation of the circular knitting machine.

The oscillating lever 7 extends, with respect to said element 6, on the opposite side of the needle 2.

The element 6 comprises a first portion 9 and a second portion 10 connected to one another by means of an elastic joint 11. The first portion 9, the second portion 10 and the elastic joint 11 are made as one piece.

The second portion 10 comprises a segmented shaped like a flattened rod resting upon and sliding against a bottom of the groove 5. The elastic joint 11 is located at an end of the segment shaped like a flattened rod and exhibits a C or open ring shape. The C shape develops continuously from the segment shaped like a flattened rod and ends joining the first portion 9. In other words, and end of the C shape is connected to the segment shaped like a flattened rod and an opposite end of the C shape is connected to the first portion 9. In the embodiment shown, an elastically deformable distal segment 12 develops from an end of the segment shaped like a flattened rod in an opposite direction to the one carrying the elastic joint 11. Also the elastically deformable distal segment 12 has a thin shape and exhibits its own distal end 13 at a distance from the bottom of the groove 5.

The first portion 9 comprises an arc shaped part 14, e.g. a sickle shape part, developing mainly between the elastic joint 11 and the needle 2 and arranged partially around said elastic joint 11, so that said part 14 and said elastic joint 11 delimit an arc shaped slot between them. This arc shaped slot extends from the bottom of the groove 5 and for about 220°-230° around the ring shape constituting the elastic joint 11. The arc shaped part 14 exhibits a height basically corresponding to a depth of the groove 5. An edge of said part 14 faces the bottom of the groove 5 and, as better shown below, defined a stroke end 15. The stroke end 15 is arranged, along a main direction of development of the drive chain 3, between the elastic joint 11 and the needle 2.

A radially outer edge 16, with respect to the arc shaped slot and to the open ring, of the arc shaped part 14 is rounded.

The first portion 9 develops mainly from the rotation pivot 8 towards the distal end 13 of the elastically deformable distal segment 12. In particular, the first portion 9 comprises a tapered shape part 17 which is made as one piece with the arc shaped part 14 and extends from the elastic joint 11 towards the distal end 13. This tapered shape part 17 exhibits an outer edge, with respect to the groove 5, on which a first butt 18 is obtained and which has an edge 19 facing the inside of the groove 5.

The elastic joint 11 is basically a torsion spring allowing the first portion 9 to rotate elastically, within certain limits, with respect to the second portion 10.

The oscillating lever 7 exhibits a proximal end 20 with a partially circular shape, which is housed inside the elastic joint 11. The C shaped elastic joint 11 partially surrounds the proximal end 20 of the oscillating lever 7, so that said proximal end 20 can rotate inside the elastic joint 11. Therefore, the elastic joint 11 also delimits, together with the proximal end 20, the rotation pivot 8 of the oscillating lever 7 as described above.

The rotation pivot 8 and the C shaped elastic joint 11 define a junction area connecting the oscillating lever 7 to the element 6 and mutually connecting also the first portion 9 to the second portion 10 of the element 6. The elastic joint 11 and the junction area are therefore partially integrated with each other.

A segment of the oscillating lever 7 is positioned between the first portion 9 and the second portion 10. The oscillating lever 7 extends beyond the distal end 13 of the elastically deformable distal segment 12 of the second portion 10 and exhibits an outer edge, with respect to the groove 5, on which at least one selecting tooth 21 and a second butt 22 are obtained. The second butt 22 is located at a distal end of the oscillating lever 7 and the selecting tooth 21 is located between the tapered shape part 17 and said second butt 22.

Along a main direction of development of the drive chain 3, i.e. along a direction of development of the groove 5, the rotation pivot 8 of the drive chain 3 is located between the needle 2 and the first butt 18 and is closer to said needle 2 than to the first butt 18 and to the second butt 22. For instance, given Y a distance between an area of interaction of the needle 2 with the drive chain 3 and the rotation pivot 8 (which coincides with the elastic joint 11), and given X a distance between the elastic joint 11 or the junction area and the first butt 18, a ration X/Y is greater than 1, e.g. this ratio X/Y is between 2 and 5. Moreover, given Z a distance between the rotation pivot 8 and the second butt 22, a ratio Z/X is greater than 2, e.g. this ratio Z/X is between 2 and 6, optionally between 4 and 5. Given K a distance between an end belonging to the element 6 exhibiting the first butt 18 and the second butt 22, a ratio K/Z is between 1.1 and 1.5 (FIGS. 3 and 9).

Figure 3:
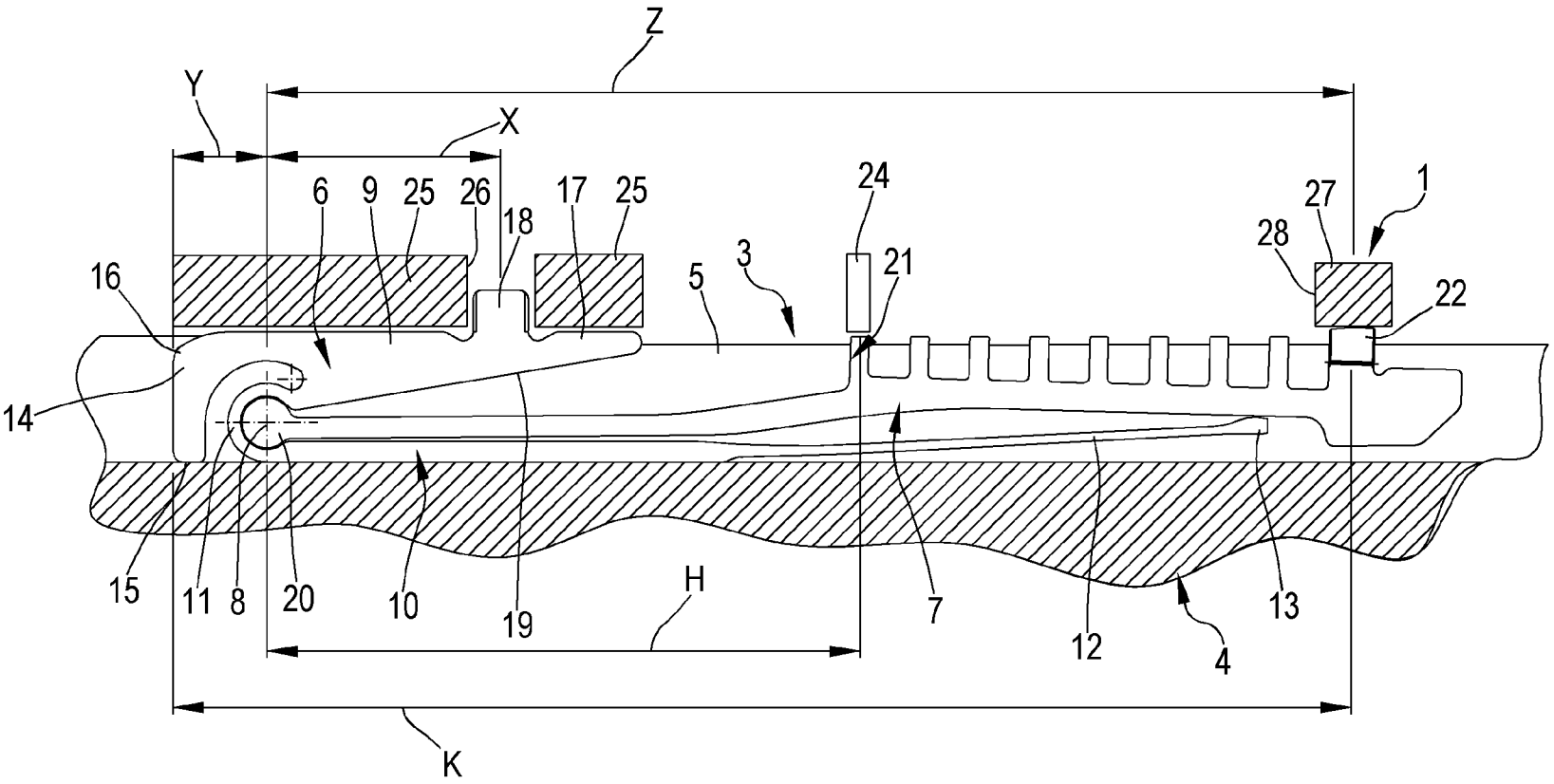
Figure 9:
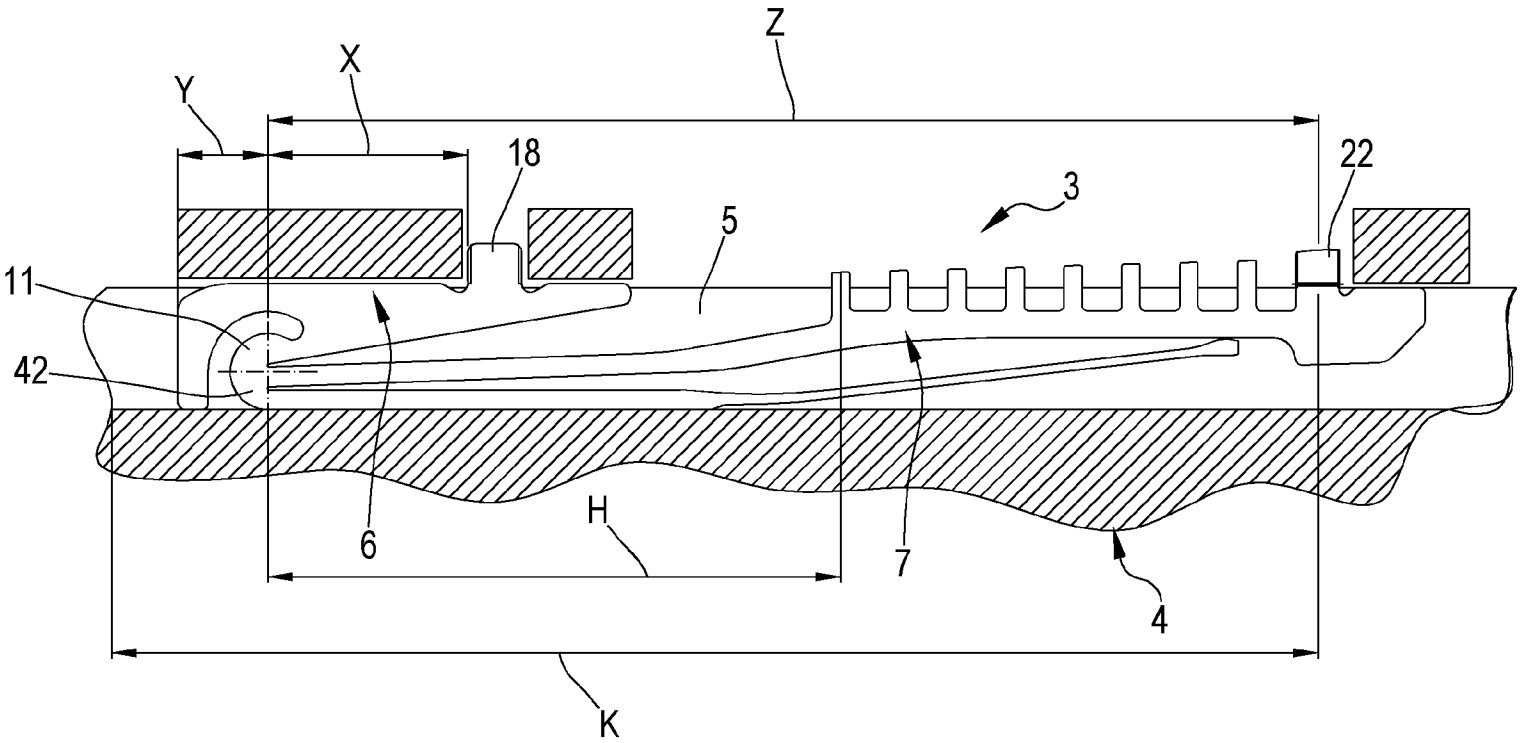
FIG. 9 shows a different embodiment of the drive chain according to the present invention.

Given H a distance between the junction area and said at least one selecting tooth 21, a ratio H/K is between 0.5 and 0.9 and a ratio H/Z is between 0.55 and 0.95 (FIGS. 3 and 9).

As can be seen in FIG. 2-5, the distal end 13 of the elastically deformable distal segment 12 of the second portion 10 rests against the oscillating lever 7 and is configured for pushing the oscillating lever 7, in particular the selecting tooth 21 and the second butt 22, out of the groove 5, i.e. for pushing and keeping said oscillating lever 7 in the extracted position.

The selecting tooth 21 is configured for interacting with at least one arm 24 of a piezoelectric selecting device 23 of arm type. FIG. 1 shows four piezoelectric selecting devices 23 of arm type which are mounted integrally to the disc 1 and to the actuating cams. The piezoelectric selecting device 23 of arm type is known per se and comprises an array of arms 24 protruding from a front face of the piezoelectric selecting device 23 and facing the needle-holding plate, the radial grooves 5 and the selecting teeth 21 of the oscillating levers 7. One of these arms 24 is also represented in FIG. 3.

As can be seen in FIG. 1, the array of arms 24 of each piezoelectric selecting device 23 comprises a plurality of arms 24 aligned along a respective common radial direction. Each of the arms 24 can be oscillated, e.g. by means of a piezoelectric control managed by the control unit of the machine, around a respective axis orthogonal to the common radial direction, between a first position and a second position. By means of said oscillation, the arm 24 is moved so as to interact or not with the selecting tooth 21 of the oscillating lever 7.

The actuating cams supported by the disc 1 comprise first actuating cams 25 delimiting first paths 26 and configured for interacting with the first butt 18, and second actuating cams 27 delimiting second paths 28 and configured for interacting with the second butt 22.

The oscillating lever 7 with the second butt 22 rotates around the rotation pivot 8 and oscillates as a result of the combined action: of the distal end 13 of the elastically deformable distal segment 12, which pushes the oscillating lever 7 towards the outside of the groove 5; of the piezoelectric selecting devices 23, which with the arms 24 push the oscillating lever 7 into the groove 5; of the second actuating cams 27, which have ramps also shaped for pushing and keeping the oscillating lever 7 inside the groove 5. As a result of these actions, the oscillating lever 7 oscillates between an extracted position, in which the second butt 22 is taken out of the respective groove 5 and is engaged with the second paths 28 defined by the second actuating cams 27, and a non-operating position, in which the second butt 22 is retracted into the respective groove 5 so as not to engage into said second paths 28.

The first portion 9 of the element 6 rotates with respect to the second portion 10 on the elastic joint 11 as a result of the combined action of the elastic force exerted by the elastic joint 11, which moves the tapered shape part 17 with the first butt 18 in a direction pointing out of the groove 5, and of the first actuating cams 25. The elastic joint 11 is configured for leaving a minimal clearance at the proximal end 20 of the oscillating lever 7 even when said elastic joint 11 is in a configuration of maximum torsion. Thus, the minimum operating clearance allows the rotation pivot 8 to rotate even when the elastic joint 11 reaches its maximum torsion.

Figure 2:
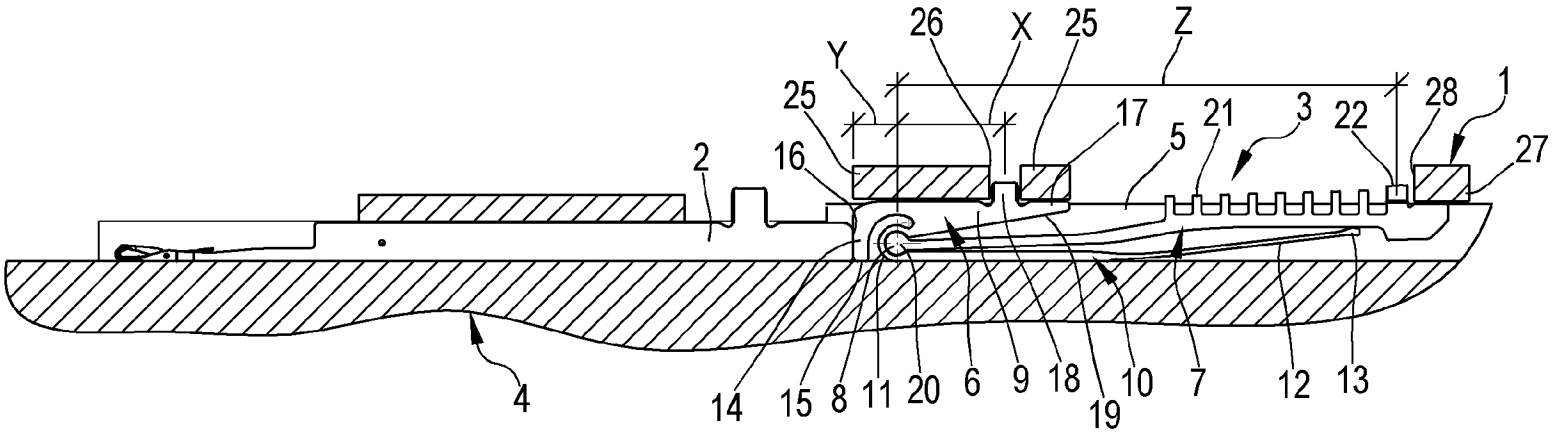
FIGS. 2, 3, 4 and 5 show one of the drive chains of FIG. 1 housed in a groove, in respective side views and in respective operating configurations.

FIG. 2 (drive chain 3 operating-"O" condition/configuration) shows the drive chain 3 with the oscillating lever 7 in the extracted position. A surface of the second actuating cam 27 facing the groove 5 prevents the oscillating lever 7 from getting out further from said groove 5, and the elastically deformable distal segment 12 keeps the oscillating lever 7 in this position by pushing the distal end of the oscillating lever 7 against said surface of the second actuating cam 27 facing the groove 5. Said distal end of the oscillating lever 7 slides against the second actuating cam 27 due to the relative rotational motion of the needle-holding plate 4 with respect to the second actuating cams 27. The first butt 18 is in an operating position in which it protrudes from the groove 5 and is housed in one of the first paths 26. The elastic joint 11 is in a basically unloaded torsion condition or is preloaded, i.e. it tends to push in a counter-clockwise direction (looking at FIG. 2) the tapered shape part 17, which thus rests and slides (due to the relative rotational motion of the needle-holding plate 4 with respect to the first actuating cams 25) against a surface of the first actuating cams 25 facing the groove 5, whereas the stroke end 15 rests against the bottom of said groove 5.

FIG. 3 (drive chain 3 with piezoelectric selecting device 23 under selection-"S" condition/configuration) shows the drive chain 3 with the oscillating lever 7 in the retracted position due to the interaction of one of the arms 24 of the piezoelectric selecting device 23 with the selecting tooth 21 of the oscillating lever 7. The first butt 18 is in the same operating position as in FIG. 2.

Figure 4:
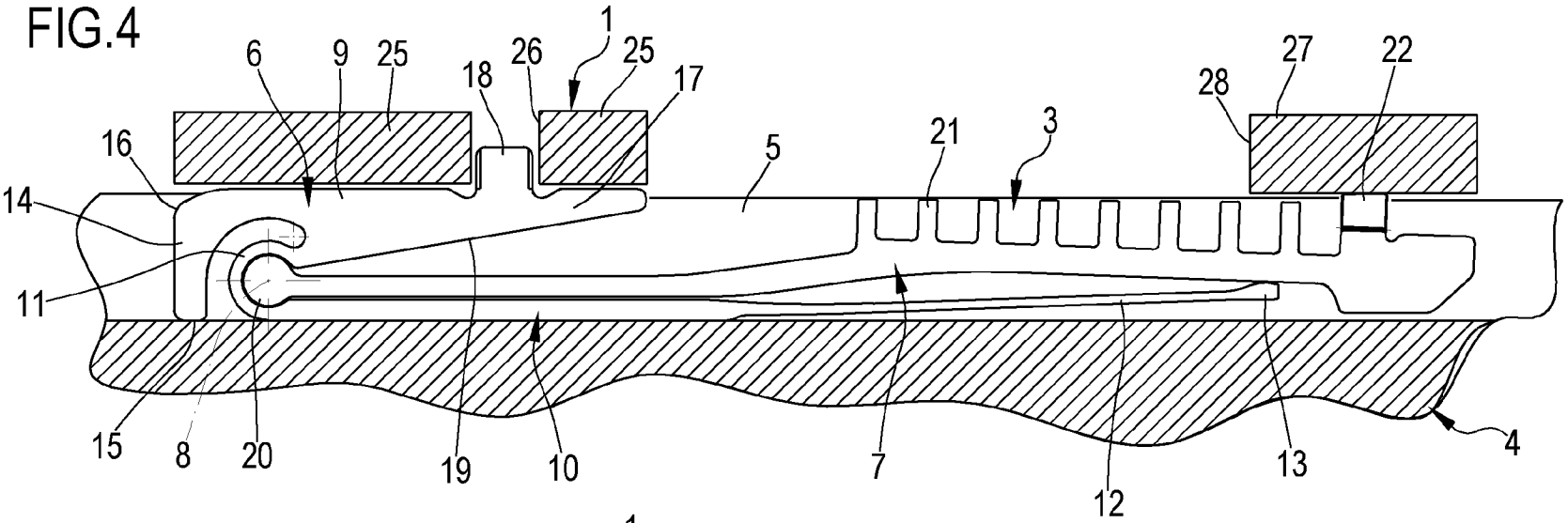

FIG. 4 (drive chain 3 with oscillating lever 7 embedded-"A" condition/configuration) shows the drive chain 3 with the oscillating lever 7 in the retracted position due to the interaction with one of the second actuating cams 27. The oscillating lever 7, moved to the retracted position by the piezoelectric selecting device 23 (as shown in FIG. 2) or as a result of engaging a ramp of one of the second actuating cams 27, is retained in this retracted position by the second butt 22 which rests and slides against the surface of the second actuating cam 27 facing the groove 5. The first butt 18 is still in the same operating position as in FIG. 2.

Figure 13:
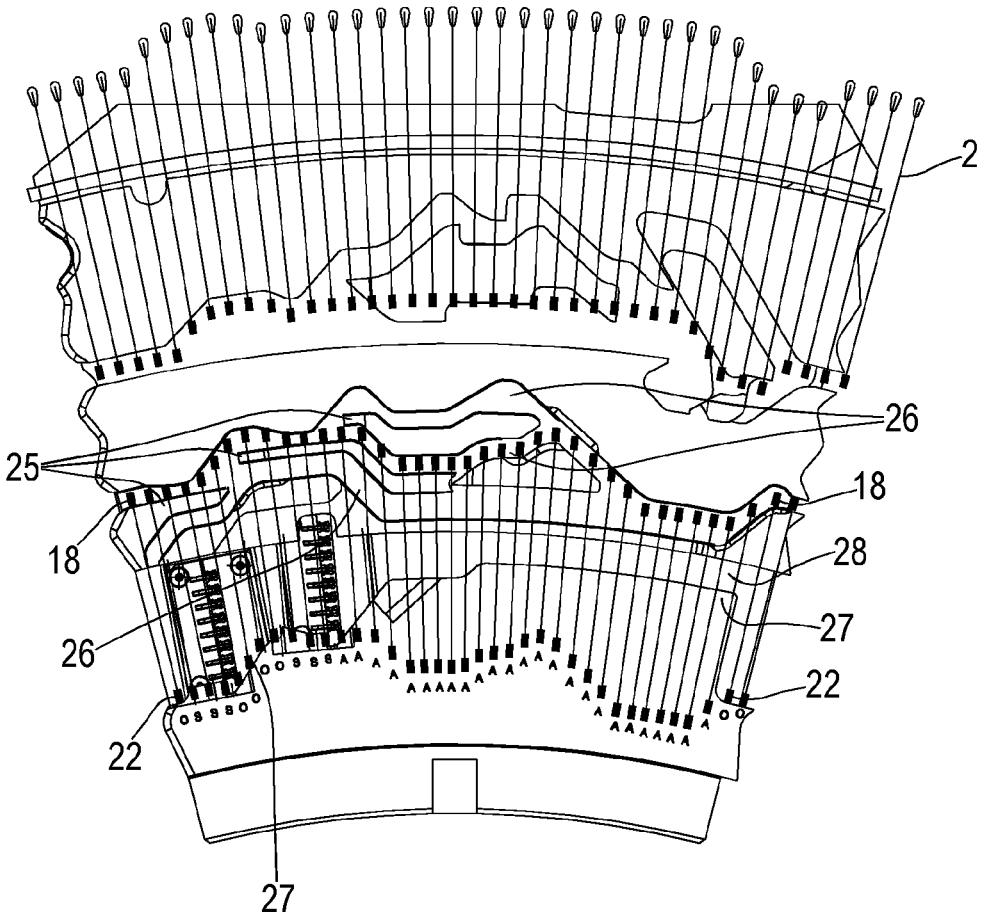
FIGS. 13 and 14 show the cams of FIG. 1 with the drive chains in respective operating conditions.
Figure 14:
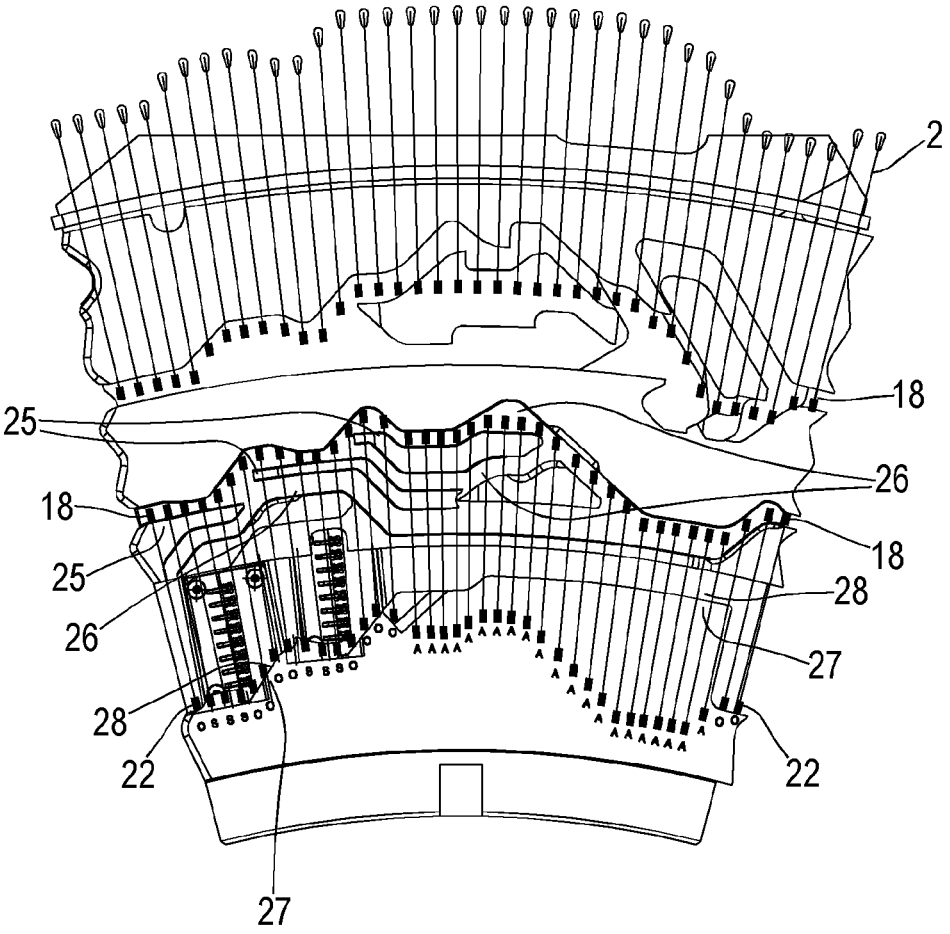

FIGS. 13 and 14 show by way of example the paths followed by the drive chains 3 (which are shown schematically with the respective first butt 18 and second butt 22) only, for loop formation (FIG. 13, "withdrawn" path) and for stitch formation (FIG. 14, "operating" path), respectively. In these FIGS. 13 and 14, the letters "O", "S", "A" associated with each position of the drive chains 3 indicate the condition/configuration of the drive chain 3 among those described above and shown in FIGS. 2, 3 and 4.

Figure 5:
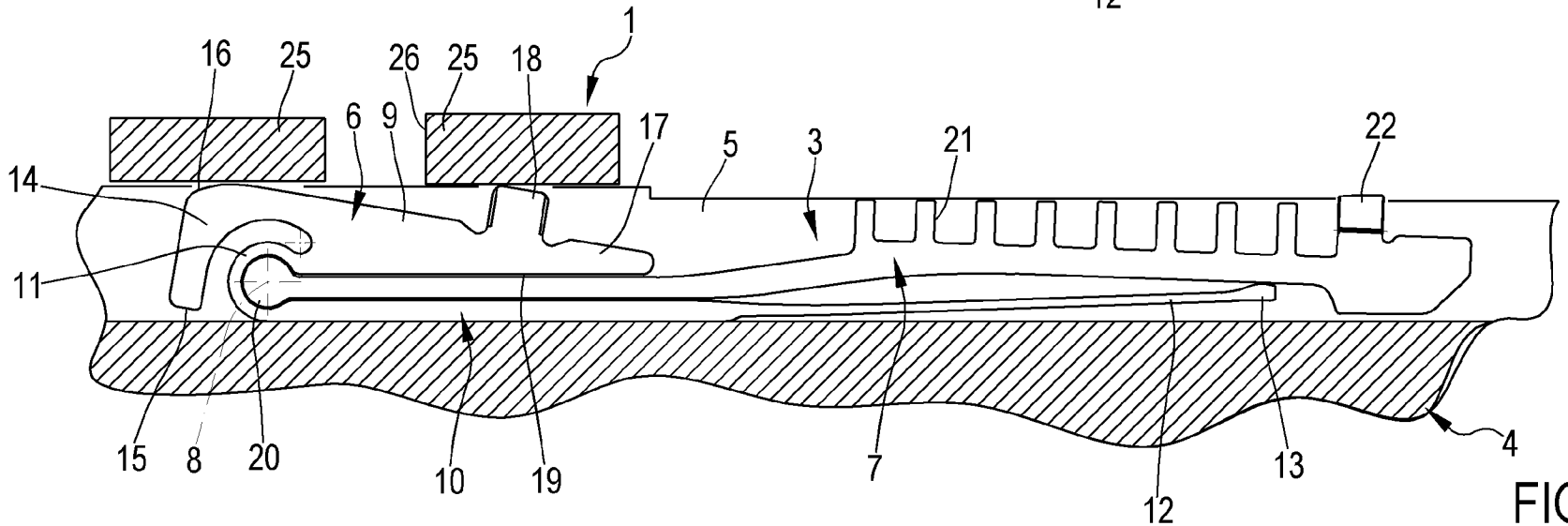

FIG. 5 (contact of first butt 18-"C" condition/configuration) shows the drive chain 3 in case of interference with one of the first actuating cams 25, i.e. if the first butt 18, instead of correctly taking a first path 26 delimited by the first actuating cams 25, by touching or sliding over a first actuating cam 25, hits the first actuating cam 25 itself.

Figure 15:
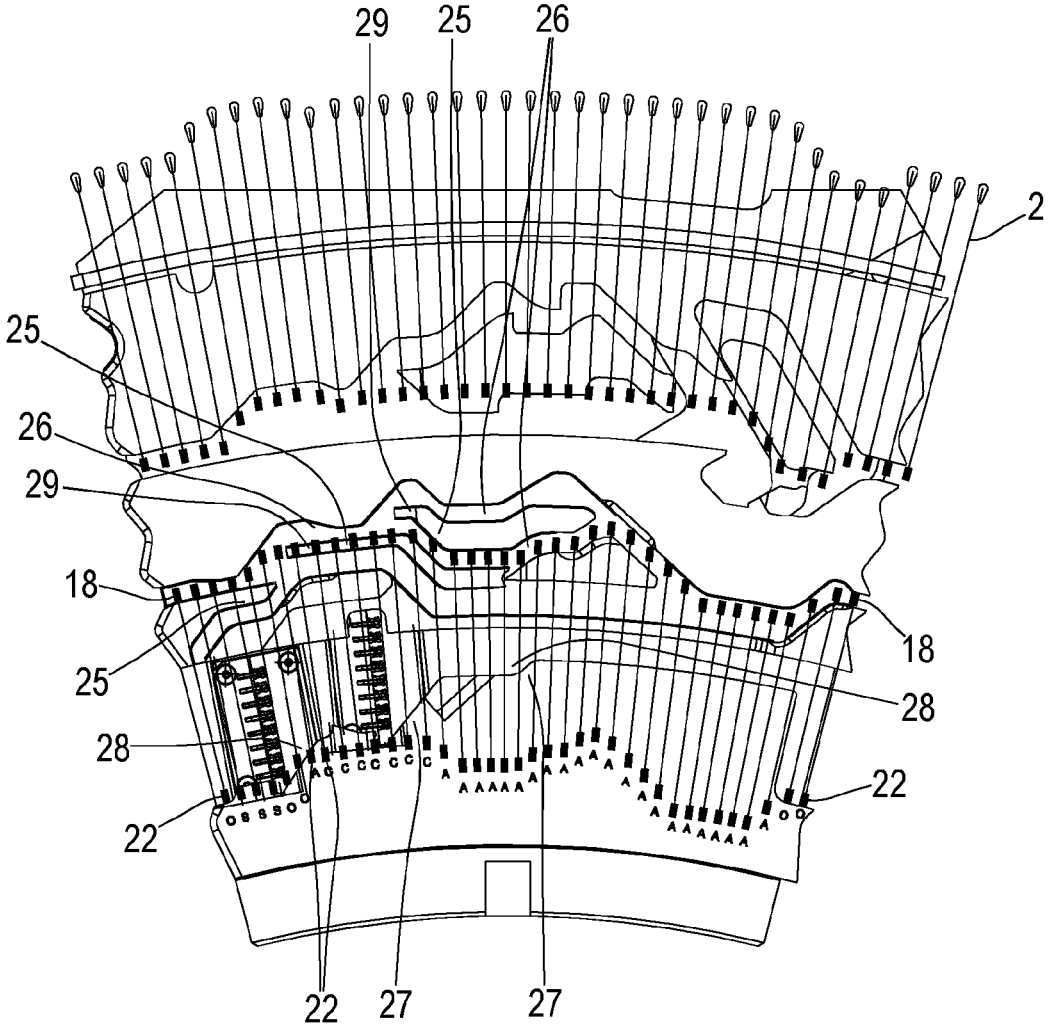
FIGS. 15 to 17 show the cams of FIGS. 13 and 14 with the drive chains during a fault condition.

For instance, as shown in FIG. 15, if due to a fault the second butt 22 of the oscillating lever 7 leaves the respective second (lifting) actuating cam 27 at about half of its lifting path, the first butt 18, instead of correctly taking one of the first paths 26 delimited above and below a deviating cam 29 (the deviating cam 29 placed below in FIG. 10) belonging to the first actuating cams 25, hits said deviating cam 29. This deviating cam 29 (shown more clearly in FIGS. 10 and 11) exhibits a ramp 30 developing from a bottom surface of the first paths 26. The first path 18 engages the ramp 30 and slides over the ramp 30 (FIG. 11) and thus the ramp 30 progressively pushes the first butt 18 into the respective groove 5, as shown in FIG. 5.

The presence of the ramp 30 therefore avoids a violent contact of the first butt 18 with the deviating cam 29, though instead this ramp 30 engages and supports the first butt 18 while getting back into the groove 5.

The interaction between the ramp 30 and the first butt 18 causes a rotation of the first portion 9 of the element 6 operatively coupled or to be coupled with the respective needle 2 around the center of rotation coinciding with the rotation pivot 8 (in clockwise direction in FIG. 5). The stroke end 15 gets away from the bottom of the respective groove 5 and the edge 19 of the tapered shape part 17 contacts the oscillating lever 7 and pushes and retains it in the non-operating position, thus contrasting the elastic action exerted by the elastically deformable distal segment 12. The radially outer, rounded edge 16 does not protrude from the groove 5 even when the first portion 9 rotates with respect to the second portion 10.

In FIG. 15, the letter "C" indicates the position of the drive chains 3 in "C" condition/configuration of FIG. 5. In the first useful space, i.e. when it finds one of the first paths 26, the first butt 18, pushed by the elastic joint 11, gets out again of the groove 5 and resumes one of the first programmed paths 26 without damage to the drive chain 3.

Figure 16:
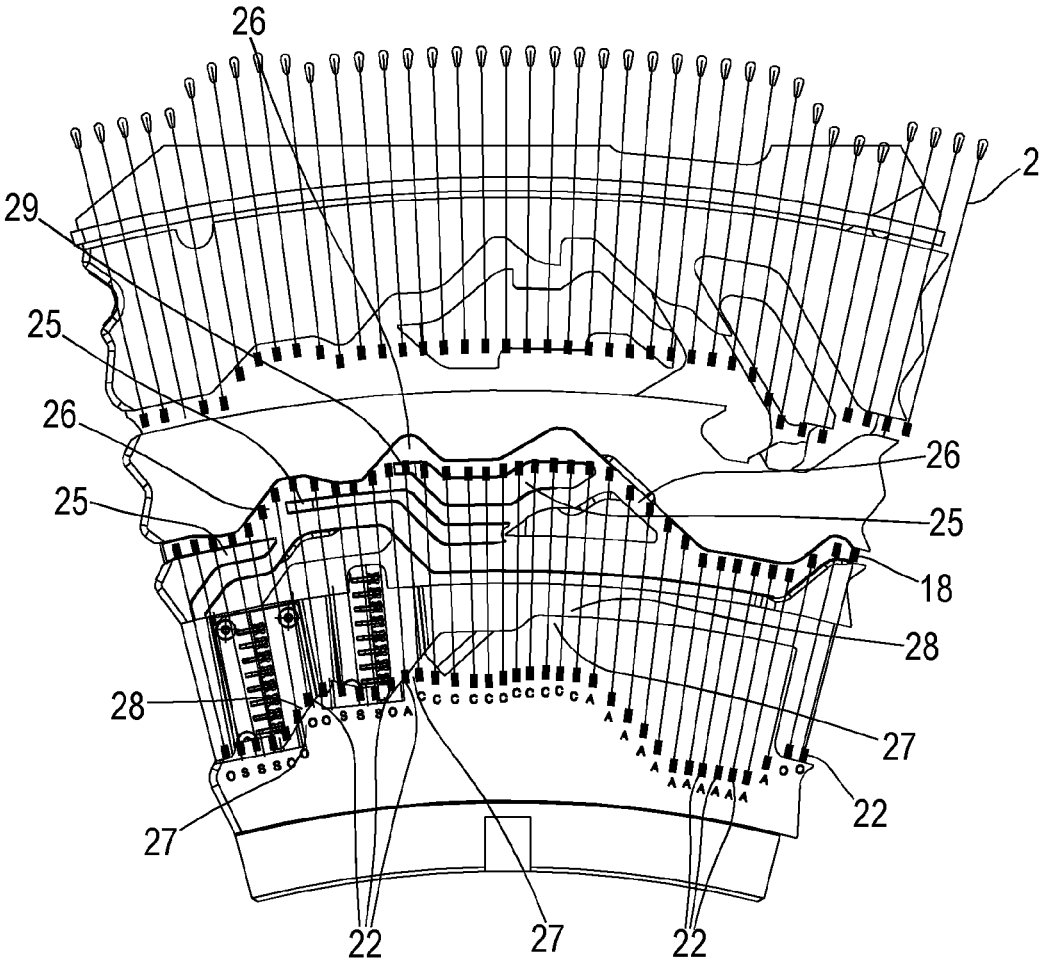

In FIG. 16, the second butt 22 of the oscillating lever 7 follows the whole of the second actuating cam 27 placed more to the left, but then leaves the second actuating cam 27 placed more the right at about half of its lifting path. The first butt 18, instead of correctly taking one of the first paths 26 delimited above or below a deviating cam 29 (the deviating cam 29 placed higher in FIG. 10) belonging to the first actuating cams 25, hits said deviating cam 29. Also this deviating cam 29 (shown more clearly in FIGS. 10 and 11) exhibits a ramp 30 developing from a bottom surface of the first paths 26. The first path 18 engages the ramp 30 and slides over the ramp 30 (FIG. 12) and thus the ramp 30 progressively pushes the first butt 18 into the respective groove 5, as shown in FIG. 5.

Here again, in the first useful space, i.e. when it finds one of the first paths 26, the first butt 18, pushed by the elastic joint 11, gets out again of the groove 5 and resumes one of the first programmed paths 26 without damage to the drive chain 3.

Figure 17:
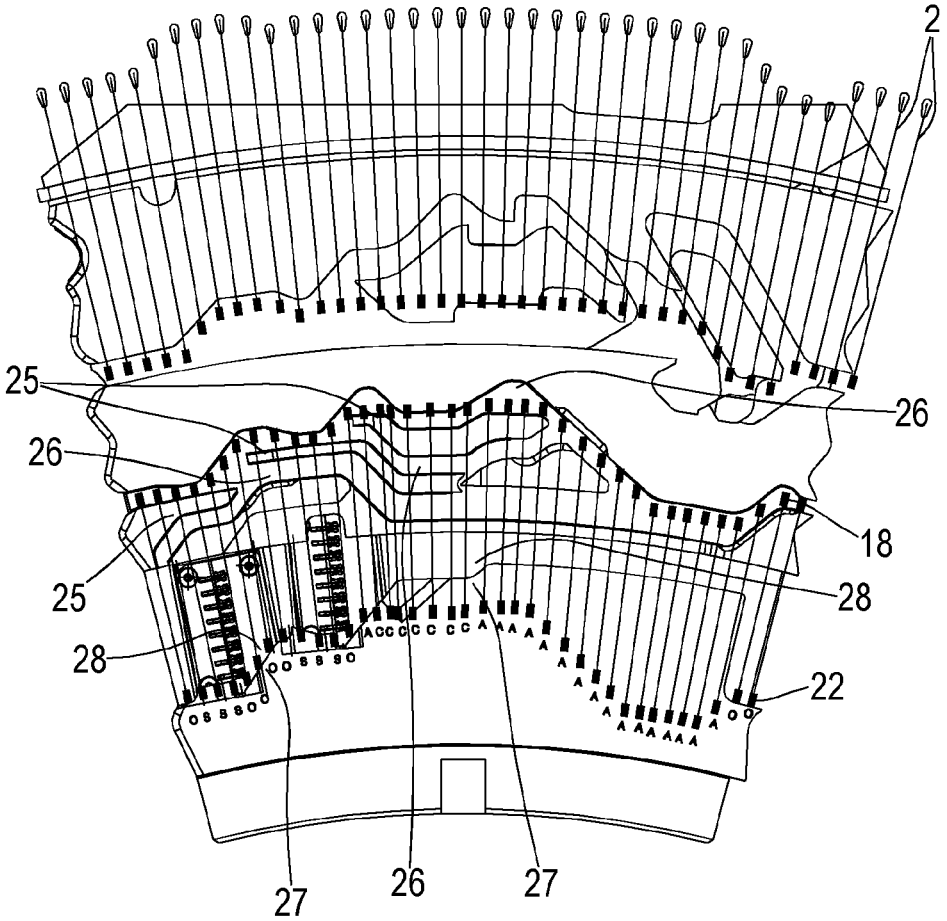

FIG. 17 shows a situation like the one in FIG. 16, but here the first butt 18 gets again out of the groove 5 and resumes one of the first paths 26 in a different place.

Figure 6:
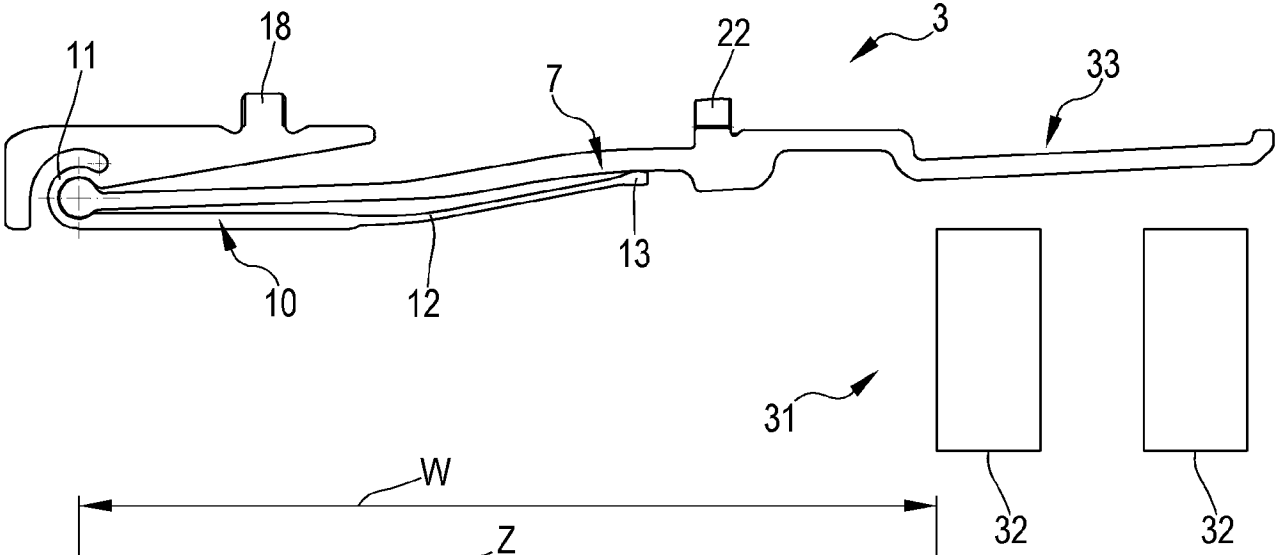
FIGS. 6, 7 and 8 show a variant of the drive chain as in the previous figures in respective operating configurations.
Figure 7:
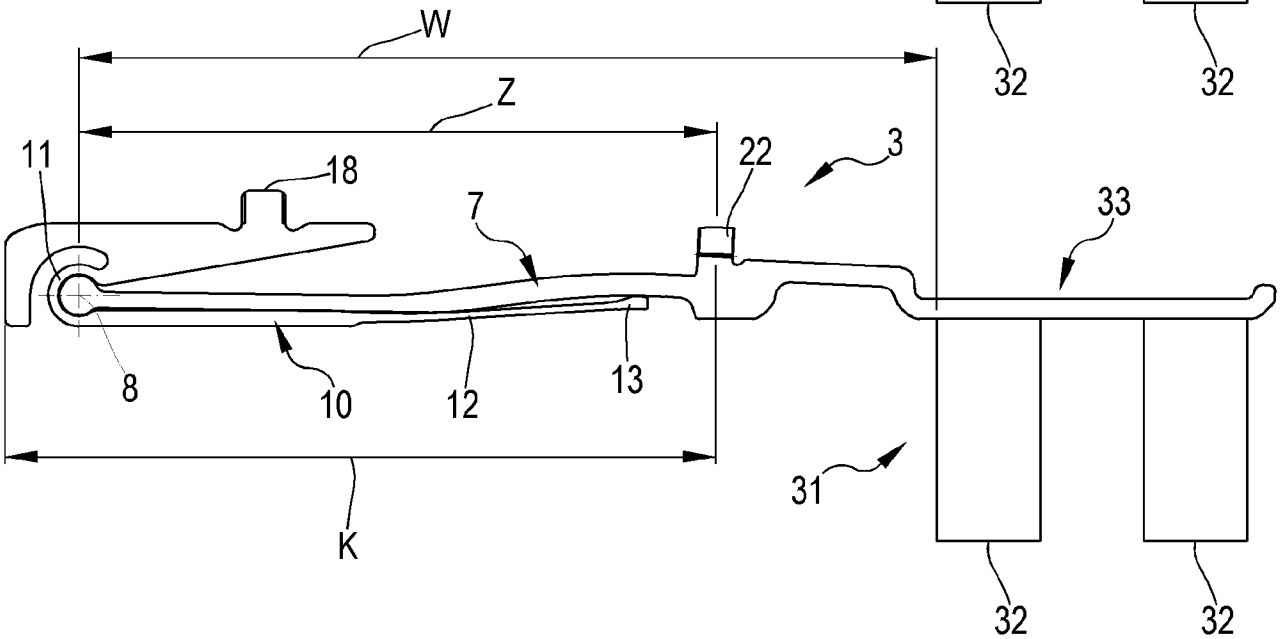
Figure 8:
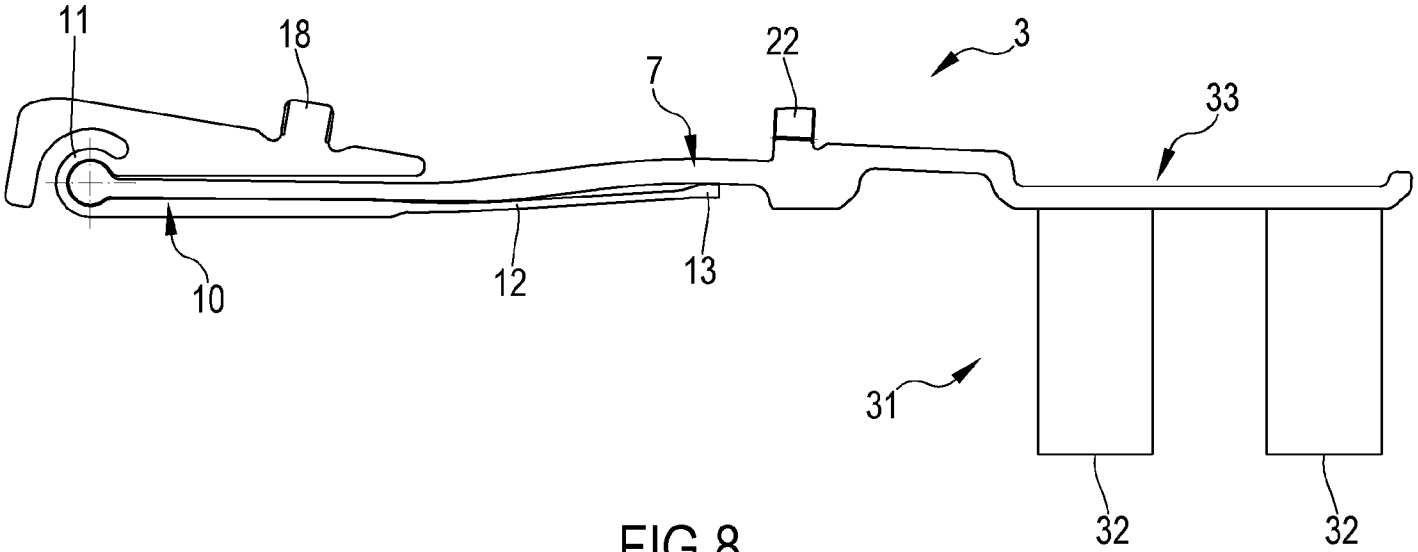

FIGS. 6, 7 and 8 show a variant of the drive chain 3 of FIGS. 2, 3, 4 and 5. This variant is structured so as to operate with selecting devices of magnetic type instead of piezoelectric selecting devices 23 of arm type as described above. The magnetic selecting device 31 shown in FIGS. 6, 7 and 8 comprises two magnets 32. The drive chain 3 of FIGS. 6, 7 and 8 differs from the one of FIGS. 2, 3, 4 and 5 in that the oscillating lever 7 is without the selecting tooth 21 and comprises instead a distal segment 33 extending beyond the second butt 22 and configured for bending elastically and interacting with the two magnets 32.

Given W a distance between the junction area and a portion of the distal segment 33 (configured for interacting with the selecting device 31 of magnetic type) placed closer to said junction area, a ratio W/K is between 1 and 1.3 and a ratio W/Z is between 1.4 and 1.8.

FIG. 6 shows the "O" condition/configuration, corresponding to the one in FIG. 2, in which the two magnets 32 are deactivated and do not attract said distal segment 33. FIG. 7 shows the "S" condition/configuration, corresponding to the one in FIG. 3, in which the two magnets 32 are active and retain the distal segment 33 so as to bend it elastically and to pre-load said distal segment 33 against the magnets 32. As is shown in FIG. 7, said portion of the distal segment 33 is the one resting against the magnet 32 which is closer to the rotation pivot 8.

FIG. 8 shows the "C" condition/configuration, corresponding to the one in FIG. 5, in which the distal segment 33 is pre-loaded against the magnets 32, like in FIG. 7, and the first butt 18 is inserted into the groove 5.

Figure 8A:
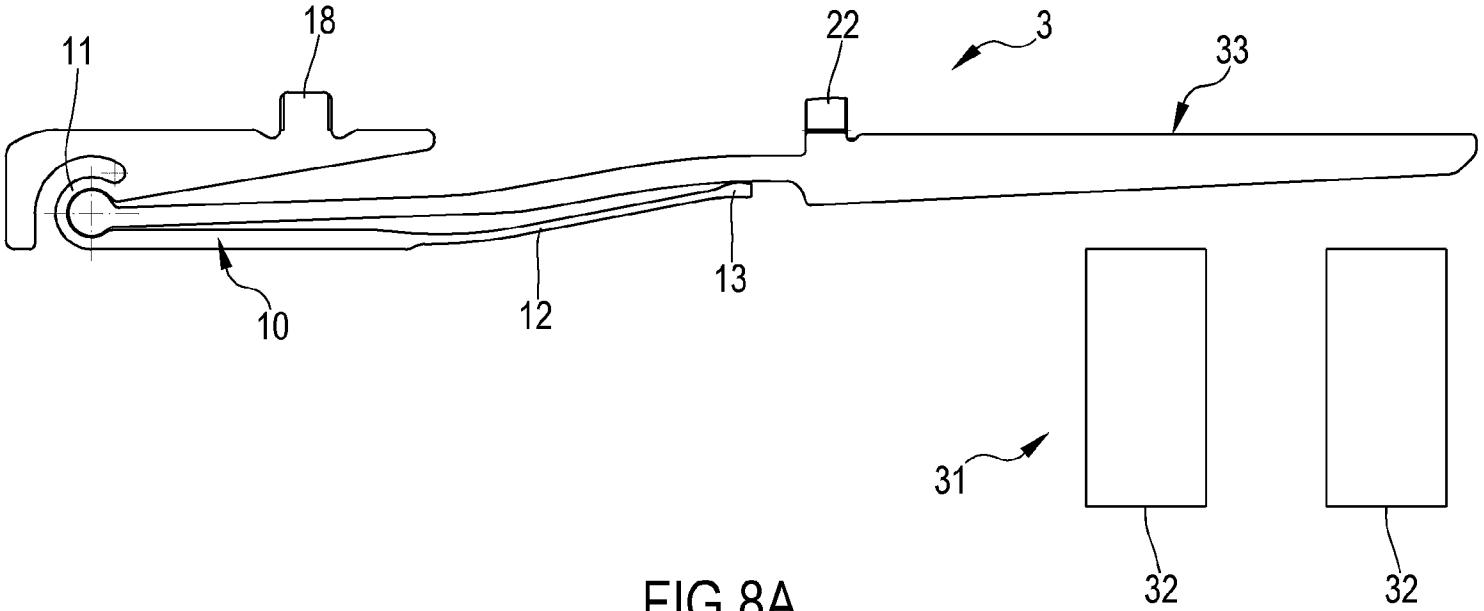
FIG. 8A shows the variant of FIGS. 6, 7 and 8 with a distal segment modified.

The drive chain 3 of FIG. 8A is basically the same as the one shown in FIGS. 6, 7 and 8, except for the fact that the distal segment 33 is stiff, i.e. it does not bend when it is pushed against the magnets 32.

FIG. 9 shows a different embodiment of the drive chain 3 which differs from the drive chain in FIGS. 2, 3, 4 and 5 in that the oscillating lever 7 is connected to the element 6 by means of an auxiliary elastic joint 42 and not by means of a pivot. The proximal end of the oscillating lever 7 is made as one piece with the elastic joint 11; in other words, the elastic joint 11 and the auxiliary elastic joint 42 are integrated with each other and the oscillation of the oscillating lever 7 is allowed by an elastic deformation of said auxiliary elastic joint 42. In FIG. 9 a proximal end of the oscillating lever 7 is located inside the C or open ring shape.

Figure 18:
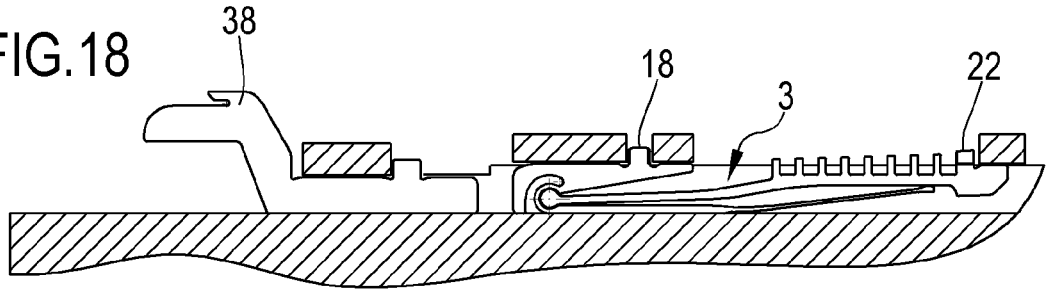
FIGS. 18 to 24 show further variants of the drive chain according to the present invention.
Figure 19:
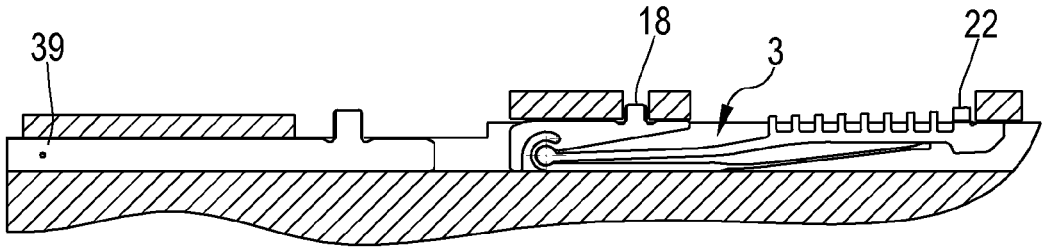
Figure 21:
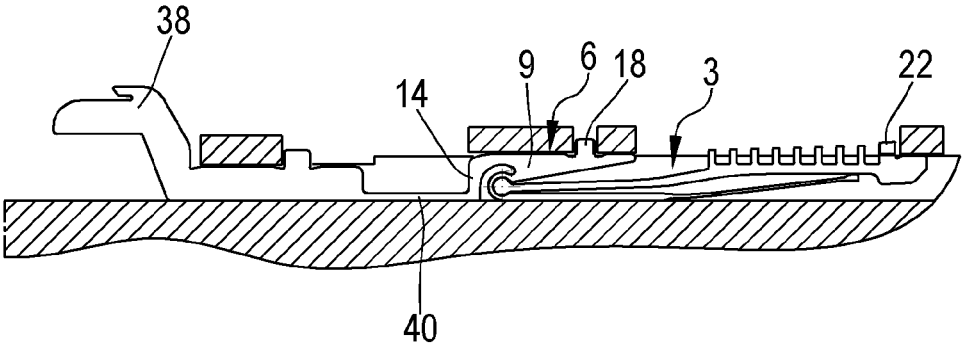
Figure 22:
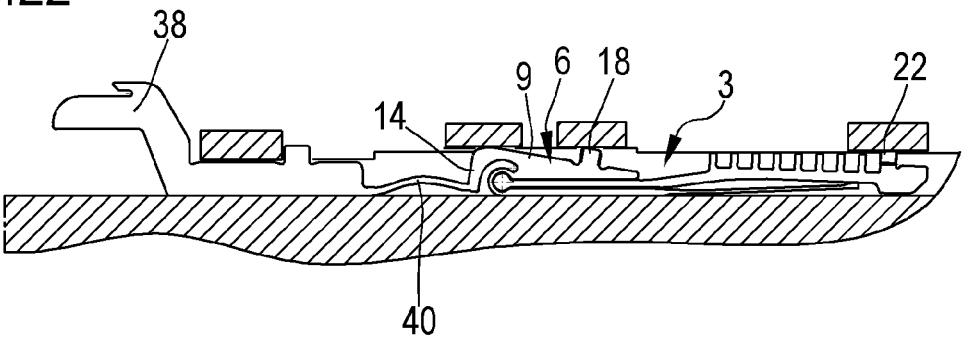

The drive chains 3 according to the present invention have been described so far in detail together with respective needles 2 and with reference to a needle-holding plate, though the present invention may be applied to any stitch formation member (e.g. needles, sinkers, punches, reeds or hooks). For instance, FIGS. 18, 21 and 22 show a sinker 38, FIG. 19 shows a hook 39.

The present invention may also be applied to any support (e.g. plate or cylinder or crown) of a circular knitting machine" having grooves 5 which house the drive chains 3 and the stitch formation members. The grooves 5 of the cylinder are usually parallel to the central axis "X-X" of the machine, whereas the grooves in the plate or crown are radial with respect to the central axis "X-X". Instead of the cylinder with the axial grooves, the support may also be defined by a drum with inclined grooves 5.

In the embodiment here described in detail, the actuating cams are fixed, i.e. they belong to the fixed disc while the needle-holding plate rotates thanks to the motor. In variants of embodiment falling within the present invention, the support provided with grooves 5 is fixed while the actuating cams are rotated around the central axis by a motor.

Moreover, the stitch formation member, i.e. the needle 2, has been disclosed so far as a separate member to be coupled with the element 6 of the drive chain 3. Also the sinker of FIG. 18 and the hook of FIG. 19 are separate from the drive chain 3.

In variants of embodiment, the stitch formation member (needle, sinker, hook, punch, etc.) can also be made as one piece with said element 6, in other words the drive chain 3 incorporates the stitch formation member.

Figure 20:
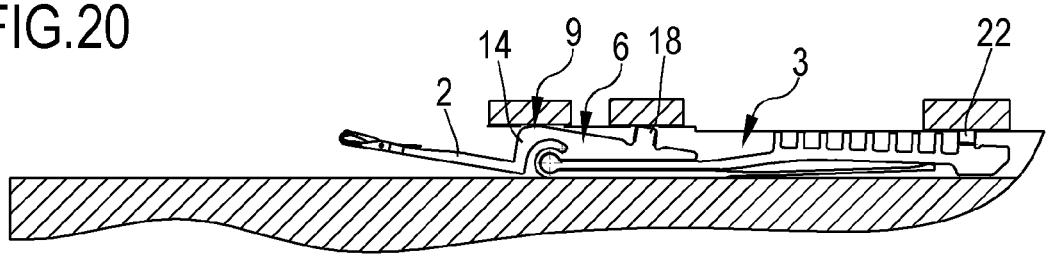

For instance, a needle 2 integrated in the drive chain 3 is shown in FIG. 20. The needle 2 is made as one piece with the element 6 exhibiting the first butt 18 and develops continuously from the arc shaped part 14. The needle 2 and the first portion 9 are stiffly connected. In case of interference with one of the first actuating cams 25 and of rotation of the first portion 9, also the needle 2 rotates together with the first portion 9. The angle of rotation is however limited and such that the needle 2 does not interfere with other parts of the machine.

The sinker 38 of FIGS. 21 and 22, conversely, is connected to the element 6 exhibiting the first butt 18 by means of a yielding, elastic connection 40, i.e. a thin, flattened portion which is made again as one piece with the sinker 2 and the drive chain 3. The connection 40 extends along the groove 5, between the arc shaped part 14 and the sinker 38.

The yielding connection 40 can transmit axial forces, i.e. pointing in the same direction as the groove 5, without deforming, so that the drive chain 3 and the sinker 38 can move axially as one piece.

The yielding connection 40 is further configured for allowing the rotation of the first portion 9 with respect to the second portion 10 while the sinker 38 is still aligned with the respective groove, i.e. it is not inclined. As shown in FIG. 22, when the first portion 9 rotates, the yielding connection 40 is bent in a radial plane and forms a sort of wave, while the sinker 38 remains where it is, i.e. it is not inclined.

Figure 23:
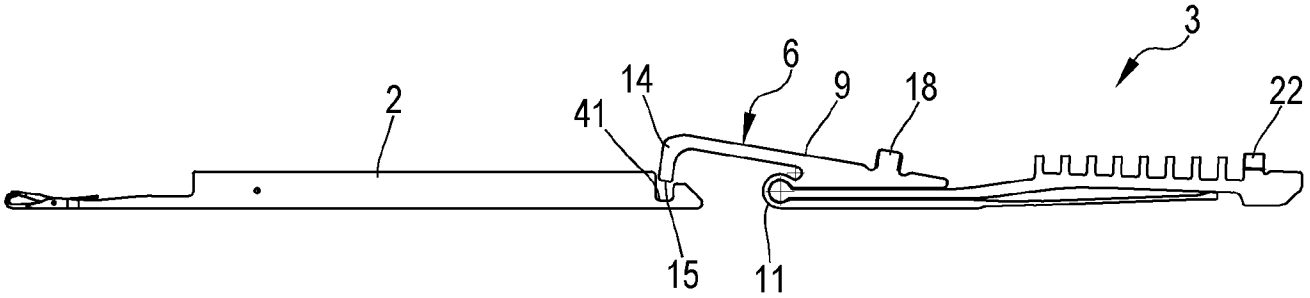
Figure 24:
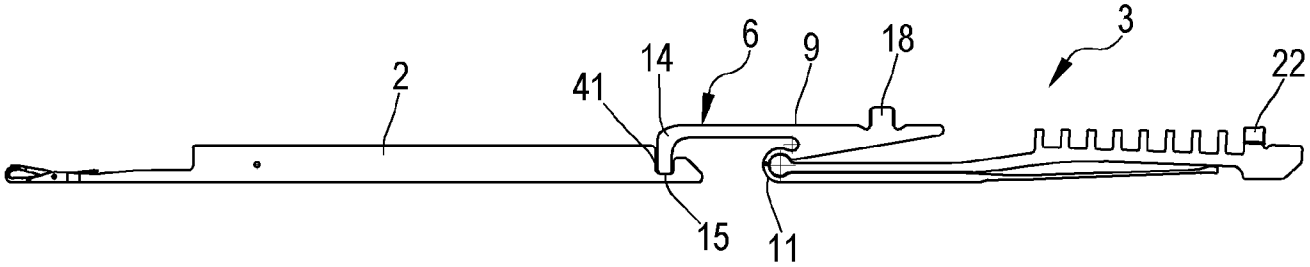

In variants of embodiment, the stitch formation member exhibits a hook so as to be hooked to the drive chain 3 and, if required, unhooked. For instance, the variant of embodiment shown in FIGS. 23 and 24 is similar to the embodiment shown in FIGS. 2-5, but the arc shaped part 14 is at a greater distance from the elastic joint 11 than the embodiment shown in FIGS. 2-5 and is sized so that the stroke end 15 defines a hook to be engaged into a seat 41 defined by a respective hook obtained in the needle 2. In FIG. 24 the needle 2 is hooked to the drive chain 3. As can be seen in FIG. 23, in case of contact of the first butt 18 and of rotation of the first portion 9 of the element 6, the needle 2 is unhooked from the drive chain 3 and does not rotate (differently from the needle 2 in FIG. 20).

LIST OF ELEMENTS

1 Disc
2 Needle
3 Drive chain
4 Needle-holding plate
5 Radial grooves
6 Element exhibiting the first butt
7 Oscillating lever
8 Rotation pivot
9 First portion
10 Second portion
11 Elastic joint
12 Elastically deformable distal segment
13 Distal end of the elastically deformable distal segment
14 Arc shaped part
15 Stroke end
16 Radially outer edge
17 Tapered shaped part
18 First butt
19 Edge
20 Proximal end of the oscillating lever
21 Selecting tooth
22 Second butt
23 Piezoelectric selecting device
24 Arm
25 First actuating cams
26 First paths
27 Second actuating cams
28 Second paths
29 Deviating cam
30 Ramp
31 Magnetic selecting device
32 Magnets
38 Sinker
39 Hook
40 Yielding connection
41 Sea
42 Auxiliary elastic joint
X-X Central axis

The invention claimed is:

1. A drive chain for stitch formation members of a circular knitting machine, comprising:

an element (6) incorporating a stitch formation member or operatively coupled or to be coupled with a stitch formation member; wherein said element (6) has a first butt (18) configured for engaging into first paths (26) defined by first actuating cams (25) of a circular knitting machine;

an oscillating lever (7) connected to said element (6) on a junction area and extending, with respect to said element (6), on the opposed side to said stitch formation member; the oscillating lever (7) exhibiting a second butt (22);

wherein the oscillating lever (7) is configured for interacting with at least one selecting device (23) of the circular knitting machine so as to oscillate with respect to said element (6) between an extracted position, in which the second butt (22) is taken out of a respective groove (5) of a support of the circular knitting machine and is engaged with second paths (28) defined by second actuating cams (27), and a retracted position, in which the second butt (22) is retracted into the respective groove (5) so as not to engage into said second paths (28);

wherein, along a main direction of development of the drive chain (3), said junction area is placed between the stitch formation member and the first butt (18).

2. The drive chain according to claim 1, wherein, designating with X a distance between the junction area and the first butt (18), and with Z a distance between the junction area and the second butt (22), a ratio Z/X is between 2 and 6.

3. The drive chain according to claim 2, wherein, designating with K a distance between an end belonging to the element (6) exhibiting the first butt (18) and the second butt, a ratio K/X is between 1.1 and 1.5.

4. The drive chain according to claim 1, wherein the oscillating lever (7) can oscillate between the extracted position and the retracted position by rotating around an axis of rotation placed in the junction area or near the junction area.

5. The drive chain according to claim 1, wherein the element (6) exhibiting the first butt (18) comprises a first portion (9) carrying the first butt (18) and a second portion (10) configured for slidingly coupling with a bottom of the respective groove (5); wherein the junction area is placed between the first portion (9) and the second portion (10) and a segment of the oscillating lever (7) is positioned between the first portion (9) and the second portion (10).

6. The drive chain according to claim 5, wherein the junction area mutually connects the first portion (9) to the second portion (10).

7. The drive chain according to claim 5, wherein the first portion (9) is elastically coupled with the second portion (10) so as to keep the first butt (18) in an operating position in which said first butt (18) protrudes from the groove (5) and to allow the first butt (18) to get back into the groove (5) in case of interference with one of the first actuating cams (25); wherein the element (6) exhibiting the first butt (18) comprises an elastic joint (11) connecting the first portion (9) to the second portion (10) so that the first portion (9) can elastically rotate with respect to the second portion (10); wherein the elastic joint (11) is placed on the junction area.

8. The drive chain according to claim 1, wherein the junction area exhibits a C or open ring shape.

9. The drive chain according to claim 1, wherein the junction area comprises said rotation pivot (8) and the oscillating lever (7) is hinged to said element (6) on said rotation pivot (8).

10. The drive chain according to claim 1, wherein the junction area comprises an auxiliary elastic joint (42) and the oscillating lever (7) is connected to said element (6) by means of said auxiliary elastic joint (42).

11. The drive chain according to claim 2, wherein the oscillating lever (7) exhibits at least one selecting tooth (21) configured for interacting with at least one arm (24) of a selecting device (23) of arm type; wherein, designating with H a distance between the junction area and said at least one selecting tooth (21), a ratio H/K is between 0.5 and 0.9 and a ratio H/Z is between 0.55 and 0.95.

12. The drive chain according to claim 2, wherein the oscillating lever (7) exhibits a distal segment (33) configured for interacting with a selecting device (31) of magnetic type; wherein, designating with W a distance between the junction area and a portion of the distal segment (33) lying nearer said junction area, a ratio W/K is between 1 and 1.3 and a ratio W/Z is between 1.4 and 1.8.

13. A circular knitting machine, comprising:

a support having a plurality of grooves (5) arranged around a central axis (X-X) of said support;

a plurality of stitch formation members, each being housed at least partially in a respective groove (5);

first actuating cams (25) and second actuating cams (27) facing the grooves (5); wherein the support is movable with respect to the first actuating cams (25) and second actuating cams (27) around the central axis (X-X) so as to determine or enable the movement of the stitch formation members along the grooves (5) for stitch formation by said stitch formation members;

a plurality of drive chains (3), each being carried out according to claim 1, housed in a respective groove (5) and integrating a stitch formation member or operatively coupled or to be coupled with a stitch formation member;

at least one selecting device (23; 31) interacting with the drive chains (3).

14. The machine according to claim 13, wherein said at least one selecting device (23) is of arm type and interacts with a selecting tooth (21) carried by the oscillating lever (7) of the drive chain (3), or wherein said at least one selecting device (31) is of magnetic type and interacts with a distal segment (33) of the oscillating lever (7) of the drive chain (3).

15. The machine according to claim 13, wherein the stitch formation member integrated into or operatively coupled or to be coupled with the drive chain (3) is a needle (2) or a sinker or a punch or a reed or a hook.

* * * * *